US009480889B1

(12) United States Patent
Abbott et al.

(10) Patent No.: US 9,480,889 B1
(45) **Date of Patent: *Nov. 1, 2016**

(54) PUTTER WITH ADJUSTABLE COMPRESSION INSERT

(71) Applicant: CALLAWAY GOLF COMPANY, Carlsbad, CA (US)

(72) Inventors: Craig E. Abbott, Vista, CA (US); James A. Seluga, Carlsbad, CA (US); William L. Hunter, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/794,061

(22) Filed: Jul. 8, 2015

Related U.S. Application Data

(63) Continuation-in-part of application No. 14/686,554, filed on Apr. 14, 2015.

(51) Int. Cl.
*A63B 53/04* (2015.01)
*A63B 53/06* (2015.01)

(52) U.S. Cl.
CPC .... *A63B 53/0487* (2013.01); *A63B 2053/0416* (2013.01)

(58) Field of Classification Search
CPC ..... A63B 53/007; A63B 2053/0416; A63B 53/0487; A63B 69/3635; A63B 53/065; A63B 2053/0412; A63B 2053/042
USPC ..... 473/324–350, 287–292, 219–256
See application file for complete search history.

(56) References Cited

U.S. PATENT DOCUMENTS 769,939 A * 9/1904 Clark ..... A63B 53/0466 273/129 R
1,562,956 A * 11/1925 Guerne ..... A63B 53/04 473/329
2,111,249 A * 3/1938 Plese ..... A63B 69/36 473/233
5,332,214 A * 7/1994 Tucker, Sr. ..... A63B 53/007 473/329
5,643,109 A * 7/1997 Rose et al. ..... A63B 53/0487 473/329
5,688,189 A 11/1997 Bland
5,899,819 A 5/1999 Mount
6,203,444 B1 * 3/2001 McRae ..... A63B 53/0487 473/244
6,238,303 B1 5/2001 Fite
6,270,423 B1 * 8/2001 Webb ..... A63B 53/0487 473/226
6,641,487 B1 11/2003 Hamburger
6,682,439 B2 1/2004 Brown
6,863,620 B2 * 3/2005 Tucker, Sr. ..... A63B 53/0487 473/288
7,192,363 B2 * 3/2007 Blankenship ..... A63B 53/04 473/326
7,354,355 B2 4/2008 Tavares et al.
7,442,129 B2 10/2008 Bardha
7,510,484 B2 3/2009 Tavares et al.
7,993,211 B2 8/2011 Bardha
8,636,607 B2 1/2014 Renna
9,072,948 B2 7/2015 Franklin et al.
2013/0178307 A1 7/2013 Wicketts

* cited by examiner

*Primary Examiner* — Sebastiano Passaniti

(74) *Attorney, Agent, or Firm* — Rebecca Hanovice; Michael Catania; Sonia Lari

(57) ABSTRACT

A putter head with means for adjusting the stiffness of a face insert is disclosed herein. The putter preferably includes a body, a first face insert comprising a cutout, a second face insert sized to fit within the cutout, an elastomeric pad, and a screw, and tightening the screw preferably causes the elastomeric pad to press against a rear surface of the second face insert and therefore change the stiffness of the second face insert.

20 Claims, 3 Drawing Sheets

PUTTER WITH ADJUSTABLE COMPRESSION INSERT

CROSS REFERENCES TO RELATED APPLICATIONS

The present application claims priority to and is a continuation-in-part of U.S. patent application Ser. No. 14/686,554, filed on Apr. 14, 2015, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a putter having an insert and features that allow a golfer to adjust the stuffiness of the insert, thus affecting its performance when contacting a golf ball.

2. Description of the Related Art

The prior art discloses several methods of adjusting face characteristics of a putter. Some examples include the embodiments shown in U.S. Pat. No. 5,688,189 to Bland, U.S. Pat. No. 5,899,819 to Mount, U.S. Pat. No. 6,238,303 to Fite, U.S. Pat. No. 6,641,487 to Hamburger, U.S. Pat. No. 6,682,439 to Brown, U.S. Pat. Nos. 7,442,129 and 7,993,211 to Bardha, and U.S. Pat. No. 8,636,607 to Renna. Many of these putters must be taken apart and reassembled by a golfer to adjust their face performance, which increases the risk of parts going missing. Thus, there is a need for a putter having adjustable face features that allow a golfer to change the compression, and thus the stiffness, of the putter face, without disassembling the club or following complicated instructions.

BRIEF SUMMARY OF THE INVENTION

One aspect of the present invention is a putter head comprising a body comprising a front surface, a back surface, a top surface, a bottom surface, a recess disposed in the front surface, and a threaded through bore extending through the back surface into the recess, a first face insert comprising a cutout, a second face insert sized to fit within the cutout, an elastomeric pad, and a screw comprising a tool engagement end, a butt end, and a plurality of threads, wherein each of the first face insert, second face insert, and elastomeric pad is disposed within the recess, wherein the second face insert is disposed within the cutout, wherein at least a portion of the screw is disposed in the threaded bore, wherein the elastomeric pad is disposed behind the second face insert, and wherein tightening the screw causes the elastomeric pad to press against a rear surface of the second face insert. In some embodiments, the putter head may comprise a movable plate, which may be disposed between the elastomeric pad and the butt end of the screw, and which may comprise a shallow recess, the butt end of the screw may be received in the shallow recess.

In a further embodiment, the putter head may comprise a first guide pin, the body may comprise a first through hole extending through the rear surface into the front recess, the movable plate may comprise a second through hole, and the first guide pin may extend through the first and second through holes along an axis perpendicular to the front surface. The putter head may further comprise a second guide pin, the body may comprise a third through hole extending through the rear surface into the front recess, the movable plate may comprise a fourth through hole, and the second guide pin may extend through the third and fourth through holes along an axis perpendicular to the front surface. In some embodiments, the first face insert may be permanently bonded within the front recess, the first face insert may comprise a first stepped portion, the second face insert may comprise a second stepped portion, the second stepped portion may engage with the first stepped portion to retain the second face insert within the cutout. In a further embodiment, the first face insert may comprise a flange proximate the first stepped portion, the putter head may comprise a movable plate disposed between the elastomeric pad and the butt end of the screw, and the movable plate may comprise a third stepped portion sized to abut the flange.

In other embodiments, the cutout may be disposed in a central area of the first face insert. In some embodiments, the elastomeric pad may be the same shape as the second face insert. In a further embodiment, the elastomeric pad may have a first thickness, the second face insert may have a second thickness, and the first thickness may be greater than the second thickness. In another embodiment, the second face insert may be composed of a nonlinear elastic material, and the first face insert may be composed of the same material as the second face insert. In some embodiments, the second face insert may be bonded to the elastomeric pad, and the elastomeric pad may be bonded to the movable plate.

Another aspect of the present invention is a golf club head comprising a body comprising a front surface, a back surface, a top surface, a bottom surface, a recess disposed in the front surface, and a threaded through bore extending through the back surface into the recess, a first face insert comprising a centrally-located cutout, a second face insert disposed within the cutout, an elastomeric pad disposed behind the second face insert, a movable plate disposed behind the elastomeric pad, and a screw comprising a tool engagement end, a butt end, and a plurality of threads, wherein at least a portion of the screw is disposed in the threaded bore, wherein the butt end is disposed behind the movable plate, wherein each of the first face insert, second face insert, elastomeric pad, and movable plate is disposed within the recess, and wherein tightening the threaded screw causes the movable plate to press against a rear surface of the elastomeric pad and the elastomeric pad to press against a rear surface of the second face insert.

In some embodiments, the rear surface of the second face insert may be bonded to a front surface of the elastomeric pad, and the rear surface of the elastomeric pad may be bonded to a front surface of the movable plate. In other embodiments, the elastomeric pad may have a first thickness, the second face insert may have a second thickness, and the first thickness may be greater than the second thickness. The putter head may further comprise a pair of guide pins, and in some embodiments the first and second face inserts may be composed of a nonlinear elastic material, the body may be composed of stainless steel, and the elastomeric pad may be composed of rubber.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
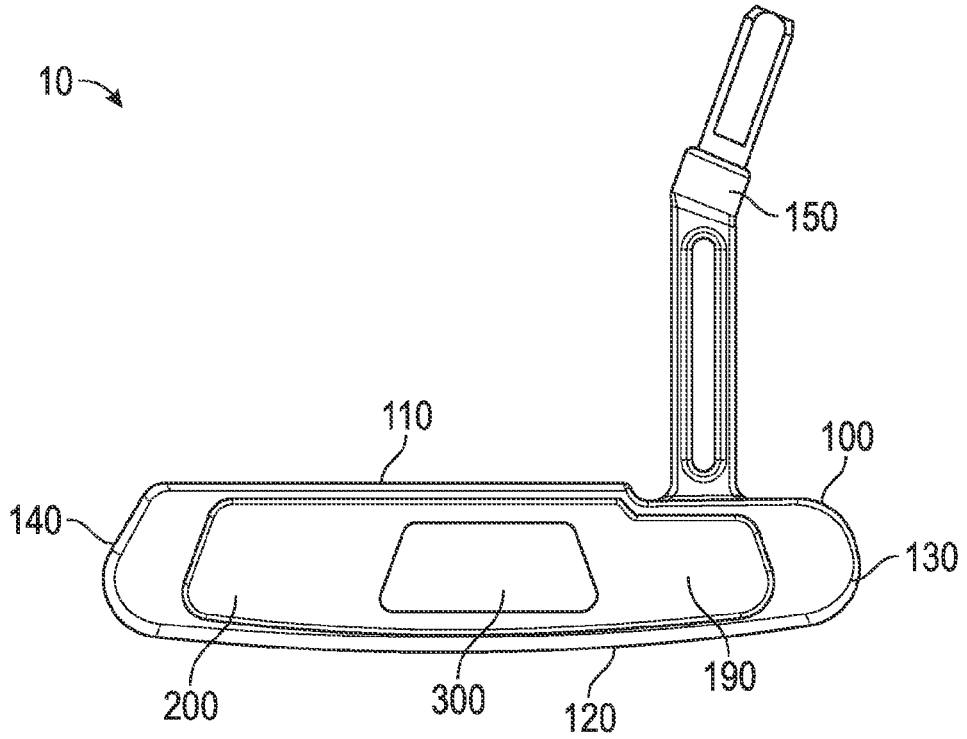
FIG. 1 is a front perspective view of a putter of the present invention.
Figure 2:
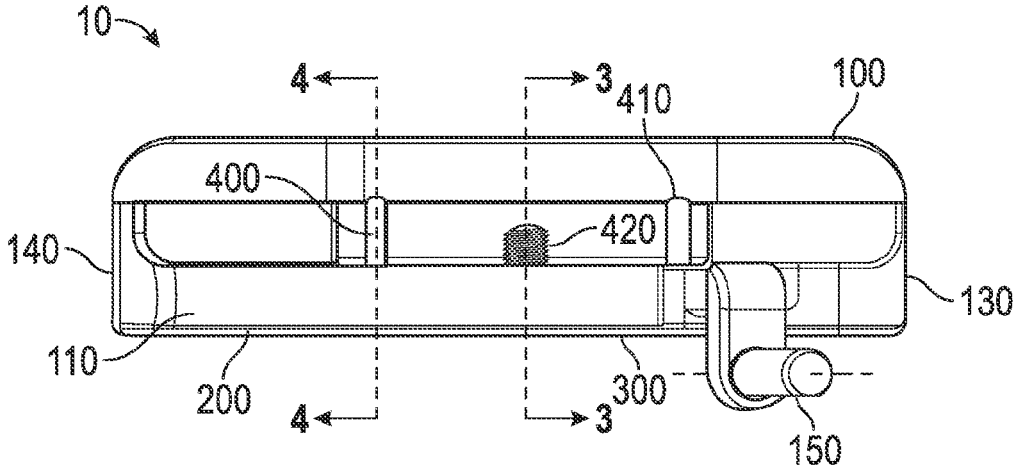
FIG. 2 is a crown perspective view of the embodiment shown in FIG. 1.

A preferred embodiment of the present invention is shown in FIGS. 1-6. The putter head 10 includes a body 100 comprising a top surface 110, a bottom surface 120, a heel side 130, a toe side 140, a hosel 150, a front recess 160, a rear face 170, and a threaded through bore 180 and two smaller, unthreaded through bores 192, 195, all extending through the rear face 170 and communicating with the front recess 160. The body 100 preferably is composed of a metal material, such as stainless steel, titanium alloy, or tungsten alloy, though in other embodiments it may be composed of a lightweight material such as composite or aluminum alloy, and may incorporate a plurality of weighting elements to achieve the mass properties desired by a golfer.

A large, primary face insert 200 is sized to fit snugly within the front recess 160, where the primary face insert 200 is permanently bonded with an adhesive 20 to the body 100 at the edges of the primary face insert 200. The primary face insert 200, which preferably is composed of a nonlinear elastic material such as rubber, or any other putter face material known to a person of skill in the art (e.g., urethane, stainless steel, aluminum alloy, titanium alloy, and the like), comprises a centrally-located cutout 210 extending through the entire width of the primary face insert 200 and a stepped portion 215 that faces the front recess 160 when the primary face insert 200 is secured within the recess 160. The cutout 210 preferably has a trapezoidal shape, though in other embodiments may be any shape desired by the manufacturer or consumer.

Figure 3:
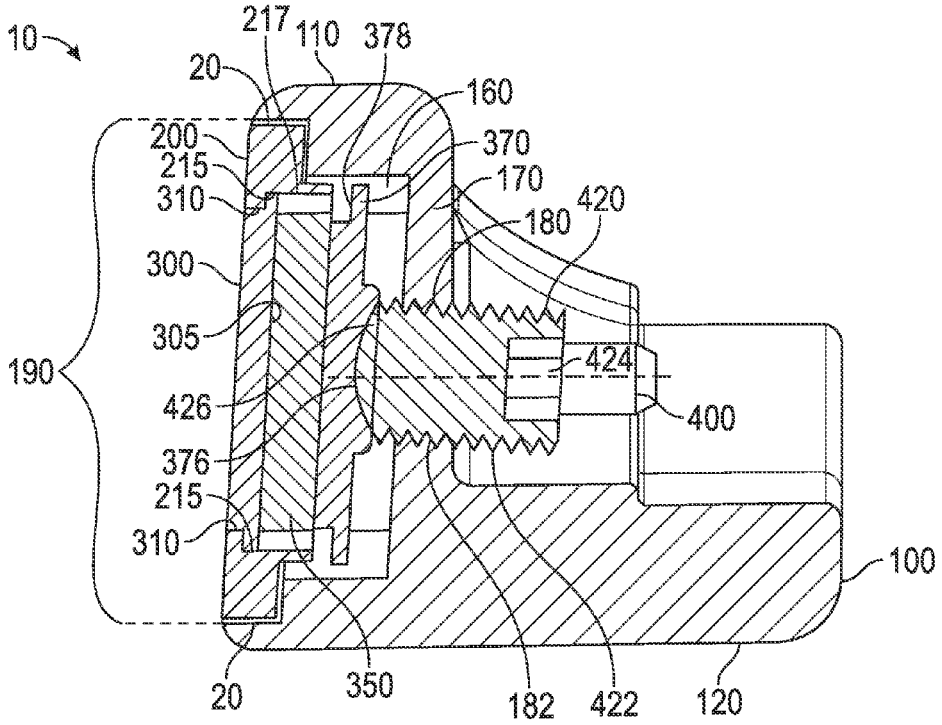
FIG. 3 is a cross-sectional view of the embodiment shown in FIG. 2 along lines 3-3.
Figure 4:
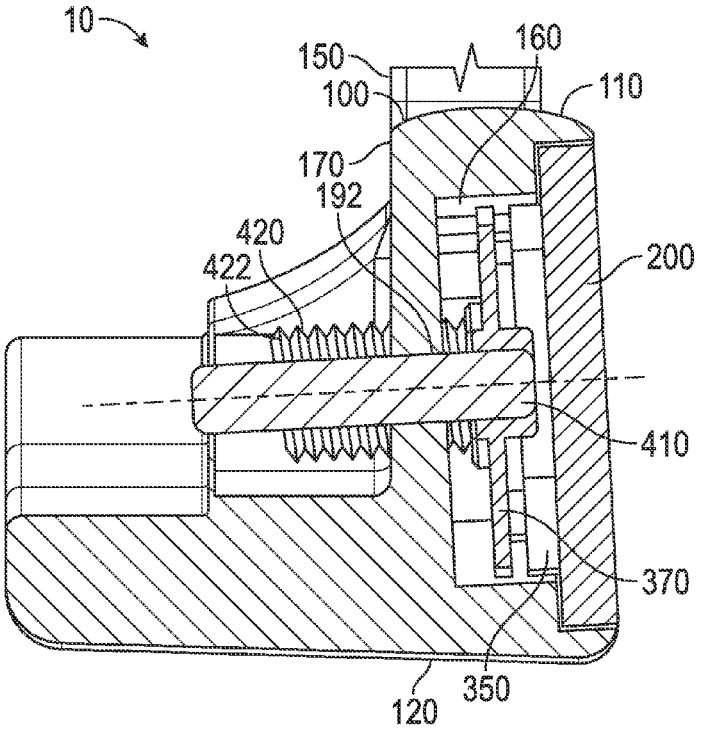
FIG. 4 is a cross-sectional view of the embodiment shown in FIG. 2 along lines 4-4.
Figure 5:
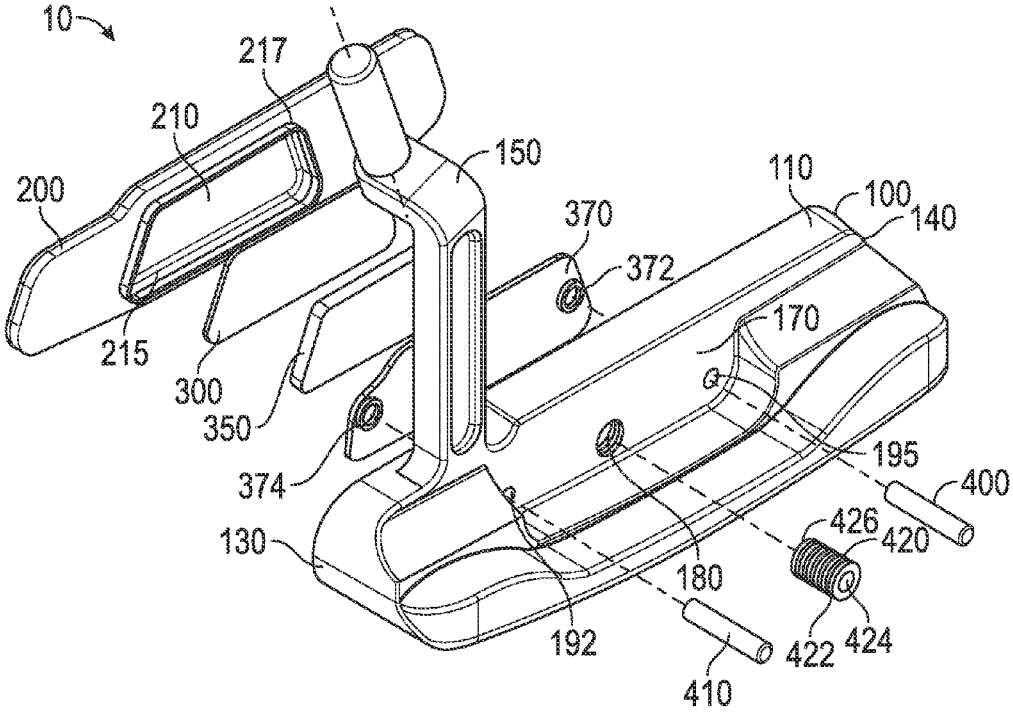
FIG. 5 is a rear perspective, exploded view of the embodiment shown in FIG. 1.
Figure 6:
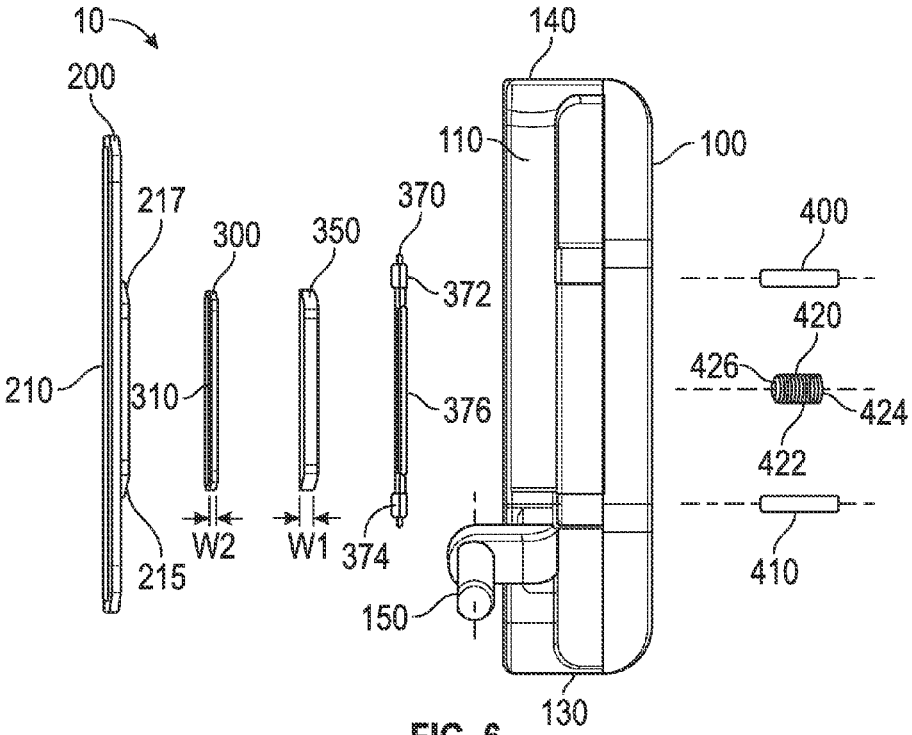
FIG. 6 is a top elevational, exploded view of the embodiment shown in FIG. 1.

The putter head 10 also includes a secondary face insert 300 sized to fit within the cutout 210. The secondary face insert 300 has the same shape as the cutout 210 and preferably is made of the same material as the primary face insert 200 but may, in alternative embodiments, be composed of different material(s). The secondary face insert 300 includes a stepped portion 310 that mates with the stepped portion 215 of the primary face insert 200 and prevents the secondary face insert 300 from falling out of the front recess 160 through the cutout 210 when the putter head 10 is fully assembled, as shown in FIG. 3. Together, the primary and secondary face inserts 200, 300 make up a striking face 190 of the putter head 10.

The putter head 10 of the present invention includes an elastomeric pad 350, which preferably is the same approximate size and shape as the secondary face insert 300, though the elastomeric pad 350 preferably has a greater width ($W_2$) than that of the secondary insert 300 ($W_1$). As shown in the Figures, the elastomeric pad 350, which preferably is composed of a rubber material, is sandwiched between the secondary face insert 300 and a movable plate 370, which includes a shallow recess 376 and a pair of through holes 372, 374 that line up with the unthreaded through bores 192, 195 in the body 100. A pair of guide pins 400, 410 extend through the unthreaded through bores 192, 195 and the through holes 372, 374 of the movable plate 370, while a threaded screw 420 comprising threads 422, a tool receiving portion 424 at a first end, and a butt portion 426 at a second end extends through the threaded through bore 180 such that the butt portion 426 is received in the shallow recess 376. Adhesive tape or another type of bonding agent known to a person skilled in the art may be applied between the elastomeric pad 350 and each of the secondary face insert 300 and the movable plate 370 so that these parts do not separate from one another when the putter head 10 is in use.

When the putter head 10 is fully assembled as shown in FIGS. 1-4, the stiffness of the secondary face insert 300 can be adjusted by turning the threaded screw 420 using a tool (not shown) such as a Torx® wrench or screwdriver. When the screw 420 is turned, the threads 422 of the screw 420 engage with the threads 182 in the threaded through bore 180 and move the screw along an axis perpendicular to the striking face 190. When the threaded screw 420 is moved towards the primary face insert 200, the threaded screw 420 extends further into the front recess 160 and places pressure on the movable plate 370 via the shallow recess 376. As the movable plate 370 moves towards the striking face 190, the movable plate 370 compresses the elastomeric pad 350 against a back side 305 of the secondary face insert 300. The closer the threaded screw 420 is to the striking face 190, the greater the pressure placed on the elastomeric pad 350 and the greater the resulting stiffness of the secondary face insert 300. Conversely, when the threaded screw 420 is moved away from the primary face insert 200, the elastomeric pad 350 rebounds to its original width and pushes the movable plate 370 away from the striking face 190, thus reducing the stiffness of the secondary face insert 200.

As shown in FIG. 3, the stepped portion 215 of the primary face insert 200 includes a flange 217 extending rearwards into the front recess 160 a distance approximately the same as the uncompressed width W1 of the elastomeric pad 350. The flange 217 preferably is spaced from the elastomeric pad 350 so that the elastomeric pad 350 has room to expand in a vertical direction when it is compressed between the secondary face insert 300 and the movable plate 370. The movable plate 370 also includes a stepped portion 378 that eventually abuts the flange 217 of the primary face insert 200 when the movable plate 370 is moved towards the striking face 190 and prevents the movable plate 370 from placing too much pressure on the elastomeric pad 350.

Each of the parts of the embodiment of the present invention may be composed of any material known to a person skilled in the art. For example, the screw 420 and guide pins 400, 410 may be composed of stainless steel, and the movable plate 370 may be composed of a lightweight, sturdy material such as composite, aluminum alloy, or plastic, or a heavier metal material such as stainless steel. Furthermore, though the parts making up the adjustable stiffness face assembly disclosed herein are shown in connection with a putter head 10, they may, in alternative embodiments, be utilized in other types of golf club heads, including drivers, fairway woods, hybrids, irons, and wedges.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A putter head comprising:

a body comprising a front surface, a back surface, a top surface, a bottom surface, a recess disposed in the front surface, and a threaded through bore extending through the back surface into the recess;

a first face insert comprising a cutout;

a second face insert sized to fit within the cutout;

an elastomeric pad; and a screw comprising a tool engagement end, a butt end, and a plurality of threads;

wherein each of the first face insert, second face insert, and elastomeric pad is disposed within the recess, wherein the second face insert is disposed within the cutout, wherein at least a portion of the screw is disposed in the threaded bore, wherein the elastomeric pad is disposed behind the second face insert, and wherein tightening the screw causes the elastomeric pad to press against a rear surface of the second face insert.

2. The putter head of claim 1, further comprising a movable plate, wherein the movable plate is disposed between the elastomeric pad and the butt end of the screw.

3. The putter head of claim 2, wherein the movable plate comprises a shallow recess, and wherein the butt end of the screw is received in the shallow recess.

4. The putter head of claim 2, further comprising a first guide pin, wherein the body comprises a first through hole extending through the rear surface into the front recess, wherein the movable plate comprises a second through hole, and wherein the first guide pin extends through the first and second through holes along an axis perpendicular to the front surface.

5. The putter head of claim 4, further comprising a second guide pin, wherein the body comprises a third through hole extending through the rear surface into the front recess, wherein the movable plate comprises a fourth through hole, and wherein the second guide pin extends through the third and fourth through holes along an axis perpendicular to the front surface.

6. The putter head of claim 1, wherein the first face insert is permanently bonded within the front recess.

7. The putter head of claim 6, wherein the first face insert comprises a first stepped portion, wherein the second face insert comprises a second stepped portion, and wherein the second stepped portion engages with the first stepped portion to retain the second face insert within the cutout.

8. The putter head of claim 7, wherein the first face insert comprises a flange proximate the first stepped portion.

9. The putter head of claim 8, further comprising a movable plate, wherein the movable plate is disposed between the elastomeric pad and the butt end of the screw, and wherein the movable plate comprises a third stepped portion sized to abut the flange.

10. The putter head of claim 1, wherein the cutout is disposed in a central area of the first face insert.

11. The putter head of claim 1, wherein the elastomeric pad is the same shape as the second face insert.

12. The putter head of claim 11, wherein the elastomeric pad has a first thickness, wherein the second face insert has a second thickness, and wherein the first thickness is greater than the second thickness.

13. The putter head of claim 1, wherein the second face insert is composed of a nonlinear elastic material.

14. The putter head of claim 13, wherein the first face insert is composed of the same material as the second face insert.

15. The putter head of claim 1, wherein the second face insert is bonded to the elastomeric pad, and wherein the elastomeric pad is bonded to the movable plate.

16. A golf club head comprising:

a body comprising a front surface, a back surface, a top surface, a bottom surface, a recess disposed in the front surface, and a threaded through bore extending through the back surface into the recess;

a first face insert comprising a centrally-located cutout;

a second face insert disposed within the cutout;

an elastomeric pad disposed behind the second face insert;

a movable plate disposed behind the elastomeric pad; and a screw comprising a tool engagement end, a butt end, and a plurality of threads, wherein at least a portion of the screw is disposed in the threaded bore, wherein the butt end is disposed behind the movable plate, wherein each of the first face insert, second face insert, elastomeric pad, and movable plate is disposed within the recess, and wherein tightening the threaded screw causes the movable plate to press against a rear surface of the elastomeric pad and the elastomeric pad to press against a rear surface of the second face insert.

17. The golf club head of claim 16, wherein the rear surface of the second face insert is bonded to a front surface of the elastomeric pad, and wherein the rear surface of the elastomeric pad is bonded to a front surface of the movable plate.

18. The golf club head of claim 16, wherein the elastomeric pad has a first thickness, wherein the second face insert has a second thickness, and wherein the first thickness is greater than the second thickness.

19. The golf club head of claim 16, further comprising a pair of guide pins.

20. The golf club head of claim 16, wherein the first and second face inserts are composed of a nonlinear elastic material, wherein the body is composed of stainless steel, and wherein the elastomeric pad is composed of rubber.

* * * * *